US006681087B2

(12) United States Patent
Whitehead et al.

(10) Patent No.: US 6,681,087 B2
(45) Date of Patent: Jan. 20, 2004

(54) SYSTEM FOR AND METHOD OF PREVENTING TONER LEAKAGE PAST DEVELOPER SEALS USING STATIC CHARGE

(75) Inventors: Dennis D. Whitehead, Boise, ID (US); Brent L. Meyer, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/103,430

(22) Filed: Mar. 21, 2002

(65) Prior Publication Data

US 2003/0180069 A1 Sep. 25, 2003

(51) Int. Cl.[7] ..... G03G 15/08
(52) U.S. Cl. ..... 399/103
(58) Field of Search ..... 399/102, 103, 399/105

(56) References Cited

U.S. PATENT DOCUMENTS 5,757,395 A 5/1998 Chew et al. ..... 347/24
5,760,817 A 6/1998 Foote et al. ..... 347/248
5,854,961 A 12/1998 Wibbels et al. ..... 399/281
6,144,820 A * 11/2000 Ishii et al. ..... 399/103 X

OTHER PUBLICATIONS

"Oasis– Tech's Tool Box– Laser Printing Process" [on–line] [Retrieved on Nov. 26, 2001]Retrieved from: http://www.oasis–imaging.com/tech/related.html, pp. 1–4.

"The PC Technology Guide– Laser Printers" [on–line] [Retrieved on Nov. 26, 2001] Retrieved from: http://www.pctechguide.com/12lasers.htm, pp. 1–8.

* cited by examiner

*Primary Examiner*—William J. Royer

(57) ABSTRACT

The present invention includes a method of sealing a toner supply to a developer sleeve including the steps of introducing a static-electric charge on toner particles to create charged toner particles and inducing an attractive charge onto each end of the developer sleeve. The static-electric charge and the attractive charge result in toner particles being attracted to the ends of the developer sleeve which create a barrier of charged toner particles to prevent leakage of the charged toner particles.

20 Claims, 2 Drawing Sheets

SYSTEM FOR AND METHOD OF PREVENTING TONER LEAKAGE PAST DEVELOPER SEALS USING STATIC CHARGE

TECHNICAL FIELD

The present invention generally relates to imaging devices and specifically to the reduction or elimination of toner leakage past toner seals in imaging devices through the use of capacitive or static charge.

BACKGROUND

Currently there are several types of technologies used in printing and copying systems. Electrophotographic printing devices such as laser printers and copiers use toner particles to form a desired image on a print medium, which is usually some type of paper. Once the toner particles are applied to the paper, the paper is advanced along a paper path to a fuser. In many printers, copiers and other electrophotographic printing devices, the fuser includes a heated fusing roller engaged by a mating pressure roller. As the paper passes between the rollers, toner particles are fused to the paper through a process of heat and pressure.

FIG. 7 is a diagram of typical laser printing device 700 employing an electrophotography (EP) process. For monochromatic printing, a single color of toner particles 701 are held in toner supply hopper 702. Toner particles 701 are typically small plastic (e.g., styrene) particles on the order of 5 microns (10–6 meter) in size. Agitator (or stirring blade) 703 is typically made of plastic such as mylar and ensures toner particles 701 are uniformly positioned along developer sleeve 705 while inducing a negative charge onto the toner particles 701 in the range of −30 to −80 micro coulomb per gram ($\mu$c/g). Developer sleeve 705 rotates in a counterclockwise direction about an internal stationary magnet 704 acting as a shaft. Toner particles 701 are attracted to the rotating developer sleeve 705 by the magnetic forces of stationary magnet 704. Doctor blade 706 charges the toner particles 701 and metes out a precise and uniform amount of toner particles 701 onto developer sleeve 705 as its outer surface rotates external to toner supply hopper 702. Developer sealing blade 707 removes excess toner particles 701 affixed to developer sleeve 705 as its outer surface rotates back into toner supply hopper 702 and prevents toner particles 701 from falling out of toner supply hopper 702 onto paper, along the length of developer sleeve 705.

Primary charging roller (PCR) 708 conditions organic photoconductor (OPC) drum 709 using a constant flow of current to produce a blanket of uniform negative charge on the surface of OPC drum 709. Production of the uniform charge by PCR 708 also has the effect of erasing residual charges left from any previous printing or transfer cycle.

A critical component of the EP process is OPC drum 709. OPC drum 709 is a thin-walled aluminum cylinder coated with a photoconductive layer. The photoconductive layer may constitute a photodiode that accepts and holds a charge from PCR 708. Initially, the unexposed surface potential of the OPC drum 709 is charged to approximately −600 volts. Typically, the photoconductive layer comprises three layers including, from the outermost inward, a charge transport layer (CTL), charge generation layer (CGL), and barrier or oxidizing layer formed on the underlying aluminum substrate. The CTL is a clear layer approximately 20 microns thick, which allows light to pass through to the CGL and controls charge acceptance to the OPC drum 709. The CGL is about 0.1 to 1 micron thick and allows the flow of ions. The barrier layer bonds the photoconductive layer to the underlying aluminum substrate.

Scanning laser beam 710 exposes OPC drum 709 one line at a time at the precise locations that are to receive toner particles 701 (paper locations which correspond to dark areas of the image being printed). OPC drum 709 is discharged from −600V to approximately −100V at points of exposure to laser beam 710, creating a relatively positively charged latent image on its surface. Transformation of the latent image into a developed image begins when toner particles 701 are magnetically attracted to rotating developer sleeve 705. Alternatively, if a nonmagnetic toner is used, developer sleeve 705 may comprise a developer roller to mechanically capture and transport toner particles 701. In this case, an open cell foam roller may be included to apply toner particles 701 to developer sleeve 705. The still negatively charged toner particles 701 held by developer sleeve 705 are attracted to the relatively positively charged areas of the surface of OPC drum 709 and "jump" across a small gap to the relatively positively charged latent image on OPC drum 709 creating a "developed" image on the OPC drum 709.

Paper to receive toner from OPC drum 709 is transported along paper path 711 between OPC drum 709 and transfer roller 712, with the developed image transferred from the surface of OPC drum 709 to the paper. The transfer occurs by action of transfer roller 712 which applies a positive charge to the underside of the paper, attracting the negatively-charged toner particles 701 and causing them to move onto the paper. Wiper blade 713 cleans the surface of the OPC drum 709 by scraping off the waste (untransferred) toner into waste hopper 715, while recovery blade 714 prevents the waste toner from falling back onto the paper. Fusing occurs as the paper, including toner particles 701, are passed through a nip region between heated roller 716 and pressure roller 717 where the toner particles 701 are melted and fused (or "bonded") to the paper. Heated roller 716 and pressure roller 717 are together referred to as the fuser assembly.

Referring to FIG. 8, color printing follows a slightly different procedure in that a foam roller 801 (1 of 4) is used to deposit particular color toner particles (e.g., CMYK: cyan, magenta, yellow and black) onto developer roller 802 for the corresponding color. Foam roller 801 is made of an open cell foam with bias, while developer roller 802 has a coated exterior charged with a bias of between −350 to −450 VDC.

One design consideration with EP imaging devices, such as laser printers, is to minimize the leakage of toner particles 701 from a toner supply hopper 702. Leakage sometimes occurs at the ends of developer sleeve 705 (FIG. 7). Several methodologies and arrangements have been used to reduce or eliminate toner leakage from the ends of developer sleeve 705. Some printers employ a foam or felt mechanical seal at the ends of developer sleeve 705 as a physical barrier to prevent toner particles from slipping past the interface between developer sleeve 705 and toner supply hopper 702. Alternatively, when the toner exhibits magnetic properties, such as in many black and white printers, magnetic seals may be provided at the ends of developer sleeve 705 to attract monochromatic toner particles and create a physical barrier, consisting of the monochromatic toner particles, to prevent additional particles from leaking. Unfortunately such techniques are generally inapplicable to the nonmagnetic type of toner used, for example, in most color printers and copiers.

Accordingly, a need exists for a structure and method for reducing toner leakage in a toner cartridge.

SUMMARY OF THE INVENTION

The present invention includes a method of sealing a toner supply to a developer sleeve, the method including the steps of introducing a static-electric charge on toner particles to create charged toner particles and inducing an attractive charge onto each end of the developer sleeve. The static-electric charge and the attractive charge result in toner particles being attracted to the ends of the developer sleeve which create a barrier of charged toner particles to prevent leakage of the charged toner particles.

Another embodiment of the present invention is directed at a sealing apparatus for sealing an interface between a toner supply and a developer sleeve. In this embodiment the invention includes electrostatically charged toner particles and a charged seal on each end of the developer sleeve.

DETAILED DESCRIPTION

The present invention addresses, inter alia, a need to reduce or eliminate leakage of color and other toner particles from printers, copiers, and similar devices. In particular, the invention is applicable to non-magnetic toners, although it may be used alone or in combination with magnetic seals and magnetic toner.

Color toner particles typically do not include iron oxide present in many monochromatic toners and are therefore not magnetic. Therefore magnetic seals cannot normally be used to reduce or eliminate leakage in color print engines. While foam and felt seals have been used, toner particles being highly fluid, still leaks past these seals. The present invention preferably introduces an electrostatic charge into the toner particles and preferably uses a capacitative charged seal at each end of a developer sleeve to reduce or eliminate the leakage of toner particles. The positively charged capacitative seal attracts electrostatically negatively charged toner particles to build and maintain a physical barrier of toner particles. The strength of the capacitative charge (e.g., voltage applied) may be varied to increase or decrease the size of the toner barrier to prevent toner leakage. Proper balancing of electrostatic charge introduced into the toner particles and the capacitative charge present on the capacitative charged seals ensures a barrier sufficient to prevent toner leakage, while limiting the width of the barrier along the developer sleeve to allow printing on the entire printable surface.

Figure 1:
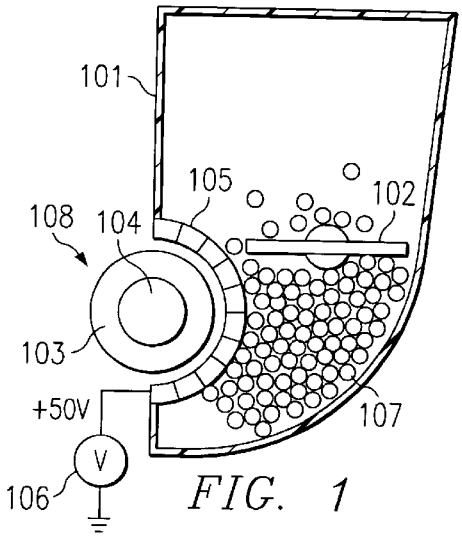
FIG. 1 is a side view of a toner hopper and includes a developer roller and seal according to an embodiment of the present invention.

FIG. 1 is an end view of one embodiment of the present invention sectioned near an end of a cartridge including a toner supply hopper 101, an agitator 102, a capacitative end seal 105 and a developer sleeve 103 of a developer roller 108. Non-magnetic toner particles 107 are held in toner supply hopper 101. As agitator 102 rotates within toner supply hopper 101 an electrostatic charge of about −30 to −40 $\mu c/g$ is created and transferred to non-magnetic toner particles 107. Capacitative end seal 105, preferably biased to about +50V, is included on each end of developer sleeve 103 surrounding central shaft 104 (see FIG. 5). Positively charged capacitative end seal 105 attracts the negatively charged non-magnetic toner particles 107, and creates a physical barrier to prevent leakage by, at least in part, holding the toner particles 107 to form a dam. Power supply 106 provides DC power for capacitative end seal 105. Note that, although the present embodiment assumes a nonmagnetic toner, it is equally applicable to magnetic toners and, in such case, is preferably used instead of or in addition to conventional magnetic toner traps or seals. Further, note that the bias voltage is selected to provide a good seal, but still allow the printing across the entire sheet of paper. The size of the dam depends on the bias voltage, the greater the bias voltage, the larger the dam, and vice versa. Thus, the voltage may be varied by the printer's processor based on the paper size being used, e.g., A4, 8½ inch, 11 inch, or other paper formats, and/or the roller size.

Figure 2:
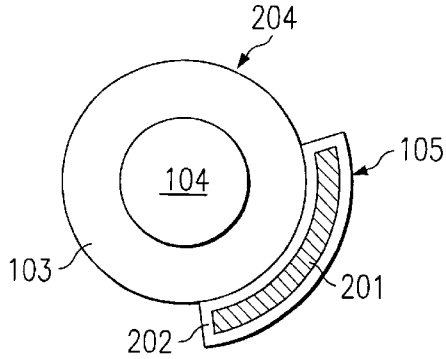
FIG. 2 is a sectional side view of a developer roller and seal arrangement according to an embodiment of the present invention.

FIG. 2 is a sectional view of a developer roller 204 including developer sleeve 103 and central shaft 104, and shows an outer surface of developer sleeve 103 in contact with end seal 105. As shown, end seal 105 may include an outer insulator 202 surrounding an inner conductor 201. Outer insulator 202 is preferably made of or includes a deformable material such as foam, felt, nylon brushes, or other suitable sealing material, that conforms to developer sleeve 103 and provides a physical barrier to toner migration past the end seal 105. If the sealing material is not itself a good electrical insulator, then a separate insulating film (not shown) may be used between the sealing material and inner conductor 201. Inner conductor 201 may be made of a variety of conductive materials such as copper, aluminum or a metal impregnated plastic such that a positive charge can be stored and maintained.

Figure 3:
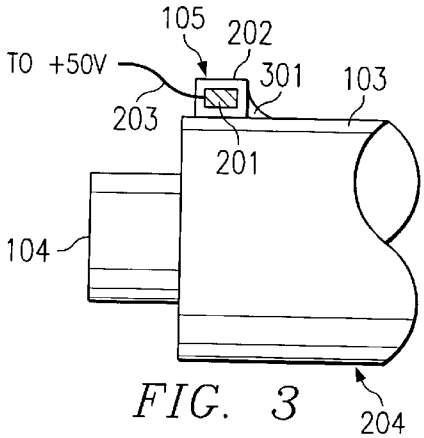
FIG. 3 is a longitudinal sectional view of a developer roller and seal arrangement according to an embodiment of the present invention.

Inner conductor 201 is positively charged by connecting it to an appropriate voltage source 106 (not shown) via wire 203 as shown in the longitudinal sectional view of FIG. 3. The positive electrostatic field created in the vicinity of inner conductor 201 attracts the negatively charged toner particles 107, causing them to create a trap region or dam 301 along an inner surface of end seal 105 and onto an adjacent portion of developer roller 204. Since the toner particles 107 are electrically isolated from inner conductor 201 by outer insulator 202, an electrostatic differential is maintained and reinforced as further negatively charged toner particles 107 collect.

Figure 4:
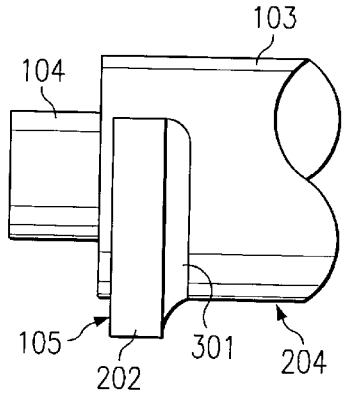
FIG. 4 is a view of developer roller and seal as viewed from inside a toner supply hopper.

FIG. 4 is a view of developer roller 204 viewed from a position inside toner supply hopper 101 and showing a buildup of toner particles 107 forming dam 301 at an interface between end seal 105 and developer roller 204.

Figure 5:
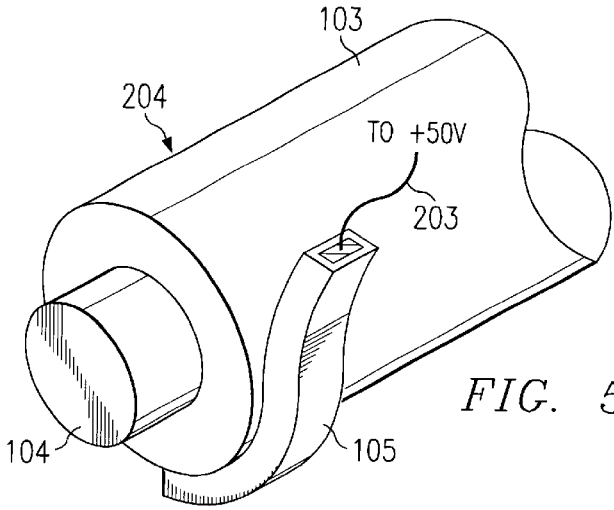
FIG. 5 is an exploded perspective view of a developer roller in mating relationship with an end seal at or close to one end of the developer roller.

FIG. 5 is an exploded perspective view of developer roller 204 as it mates with end seal 105 at or close to one end of the developer roller 204. Although not shown, a similar end seal 105 is positioned at the far end of developer roller 204 to contain toner particles 107 and inhibit it from leaking out through that end of the toner cartridge.

Figure 6:
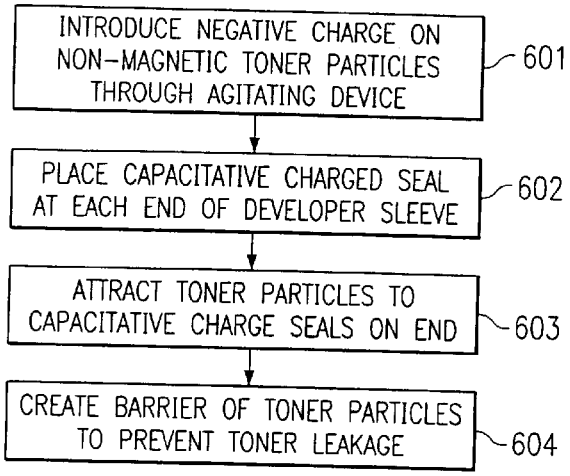
FIG. 6 is a flow chart of a method according to one embodiment of the present invention.
Figure 7:
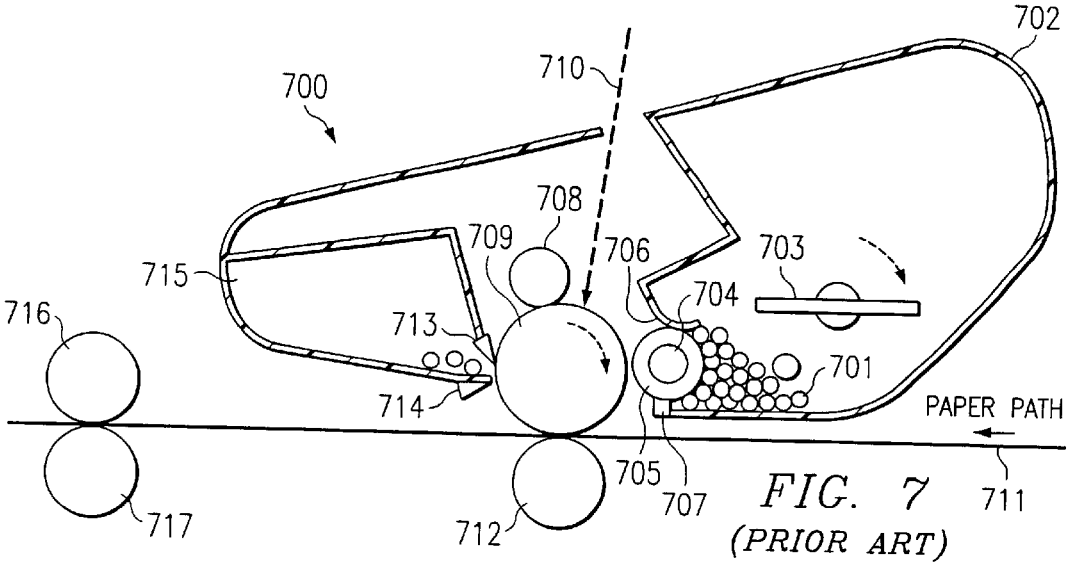
FIG. 7 (PRIOR ART)
FIG. 7 is side view of a simplified cartridge cross-section according to the prior art.
Figure 8:
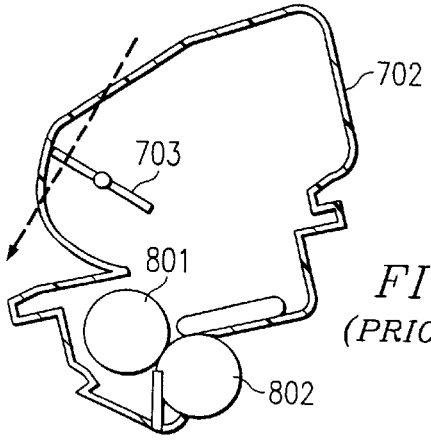
FIG. 8 (PRIOR ART)
FIG. 8 is a side view of a simplified cartridge cross-section for color toner particles according to the prior art.

FIG. 6 is a flow chart depicting the steps required to create and use the toner barrier of the present invention. In step 601 a negative electrostatic charge is introduced into the non-magnetic toner particles by, for example, an agitating device as shown in FIG. 1 as 102. In step 602 a capacitative charged seal is included on each end of the developer sleeve. The electrical characteristics of a electrostatically charged non-magnetic toner particles and the capacitative charged seal are adjusted so that toner particles are attracted to the capacitative charged seals in step 603. This attraction creates a physical barrier, made up, at least in part by the toner particles, in step 604, which reduces or eliminates leakage of toner particles from the device.

What is claimed is:

1. A method of sealing a toner supply to a developer sleeve, said method including the steps of:

introducing a static-electric charge on toner particles to create charged toner particles; and inducing an attractive charge onto each end of said developer sleeve; said static-electric charge and said attractive charge resulting in toner particles being attracted to the ends of the developer sleeve which create a barrier of charged toner particles to prevent leakage of said charged toner particles.

2. The method of claim 1, wherein the step of introducing said static-electric charge on said toner particles includes the step of rotating an agitating device within said toner supply.

3. The method of claim 1, wherein the step of inducing an attractive charge onto each end of said developer sleeve includes the step of attaching a charged seal to a power supply.

4. The method of claim 1, wherein the step of inducing an attractive charge onto each end of said developer sleeve includes the step of adjusting a negative charge introduced on said toner particles and a charge on a charged seal so as to attract charged toner particles to the charged seal.

5. The method of claim 1, wherein the step of inducing an attractive charge onto each end of said developer sleeve includes the step of adjusting the difference in a negative charge introduced in said toner particles and a charge on a charged seal so as to print to any portion of a printable medium.

6. A sealing apparatus for sealing an interface between a toner supply and a developer sleeve, comprising:

electrostatically charged toner particles; and a charged seal on each end of said developer sleeve.

7. The sealing apparatus of claim 6, further including an agitating device for placing an electrostatic charge on toner particles to create said electrostatically charged toner particles.

8. The sealing apparatus of claim 6, further including a power supply attached to said charged seal.

9. The sealing apparatus of claim 6, wherein an electrostatic charge on said electrostatically charged toner particles and a charge on said charged seal are adjusted so as to attract charged toner particles to the charged seal.

10. The sealing apparatus of claim 6, wherein a size of a barrier is adjusted to allow printing on any portion of a printable medium.

11. The sealing apparatus of claim 6, wherein said charged seal comprises an inner conductor enclosed within an insulator and a sealing surface in contact with an outer surface of said developer sleeve.

12. The sealing apparatus of claim 6, further comprising a barrier of charged toner particles at said charged seal to prevent leakage of said charged toner particles.

13. The sealing apparatus of claim 6, further comprising a magnetic core positioned within said developer sleeve.

14. A toner cartridge comprising:

a toner supply hopper;

a toner agitator operable to stir toner stored in said toner supply hopper and impart a static-electric charge to;

an organic photoconductor drum;

a developer roller operable to transport said toner from said toner supply hopper and present said toner to said organic photoconductor drum;

a pair of end seals positioned at opposite ends of said developer roller, said end seals connected to a voltage source so as to maintain a charge on said pair of end seals so as to attract said toner;

a transfer roller positioned opposite said organic photoconductor drum and configured to attract toner from said organic photoconductor drum onto a media; and a fuser assembly for fusing said toner onto said media.

15. The toner cartridge of claim 14, wherein each of said pair of end seals further comprising an inner conductor portion, an outer insulator portion, and an electric connection to said inner conductor portion.

16. The toner cartridge of claim 14, further comprising an electrical connection for supplying a voltage from said voltage source to an inner conductor portion of each of said pair of end seals.

17. The toner cartridge of claim 14, wherein each of said pair of end seals comprises an outer deformable seal portion conforming to an outer surface of said developer roller.

18. The toner cartridge of claim 14, further comprising a doctor blade operative to meter a toner coating formed on said developer roller.

19. The toner cartridge of claim 14, wherein said developer roller comprises a foam outer sleeve portion.

20. The toner cartridge of claim 14, further comprising a magnetic core located in said developer roller.

* * * * *